US006526955B1

(12) United States Patent
Juan

(10) Patent No.: US 6,526,955 B1
(45) Date of Patent: Mar. 4, 2003

(54) LACQUER BULLET GUN FEEDING SYSTEM

(76) Inventor: Chih-Chen Juan, No. 278, Lan Tan, Tung-Yang Hsin-Chun, Chiayi City (TW)

( * ) Notice: Subject to any disclaimer, the term of this patent is extended or adjusted under 35 U.S.C. 154(b) by 0 days.

(21) Appl. No.: 09/954,116

(22) Filed: Sep. 11, 2001

(51) Int. Cl.[7] ..... F41B 11/02
(52) U.S. Cl. ..... 124/49
(58) Field of Search ..... 124/48, 49, 51.1

(56) References Cited

U.S. PATENT DOCUMENTS 5,282,454 A * 2/1994 Bell et al. ..... 124/49
5,947,100 A * 9/1999 Anderson ..... 124/49 X
6,305,367 B1 * 10/2001 Kotsiopoulos et al. ..... 124/49
6,415,781 B1 * 7/2002 Perrone ..... 124/51.1

* cited by examiner

*Primary Examiner*—John A. Ricci
(74) *Attorney, Agent, or Firm*—Pro-Techtor International Services

(57) ABSTRACT

A lacquer bullet gun feeding system, comprising a storing case, a feeding opening, a feeding tube, a motor, a battery, and a funnel-shaped turntable. The storing case, has a curved inner side, accommodating lacquer bullets, with the feeding opening placed at a lowermost location thereof. The feeding tube continues from the feeding opening, guiding the lacquer bullets into a lacquer bullet gun. The motor is fastened on one side of the feeding tube, driving a cog via speed-changing gear, with the cog in turn driving a large gear. The battery supplies the motor with power. The funnel-shaped turntable is placed on the feeding opening, having an inclined wall with at least one upward projection and a downward extending tube body, surrounded by the large gear which is fixed thereon, so that the funnel-shaped turntable rotates as driven by the cog.

1 Claim, 4 Drawing Sheets

LACQUER BULLET GUN FEEDING SYSTEM

BACKGROUND OF THE INVENTION

1. Field of the Invention

The present invention relates to a lacquer bullet gun feeding system, particularly to a lacquer bullet gun feeding system ensuring smooth feeding and reducing blocking of bullets.

2. Description of Related Art

In popular war games, war scenes of dueling parties are simulated, providing for interesting and exciting entertainment, which is appealing especially to young people. For these war games, lacquer bullet guns are used which are powered by compressed gas. Lacquer bullets that are loaded into a lacquer gun are taken along by compressed gas flow and pushed out. Lacquer bullets to be fired are placed in a storing case. For continuous firing, stored lacquer bullets fall successively into a feeding tube to be fired from within the lacquer bullet gun.

A conventional storing case and feeding system, as shown in FIG. 3, comprises: a storing case 10, having a curved inner side; a feeding opening 11 at a lowermost location of the storing case 10; and a feeding tube 12, continuing from the feeding opening 11.

For taking advantage of the conventional storing case and feeding system, the lacquer bullets have a round shape, thus rolling along the curved inner side of the storing case 10, reaching the feeding opening 11. Usually a user continually sways the lacquer bullet gun, stirring the lacquer bullets, so that the lacquer bullets by their own weight fall down from the feeding opening 11. However, the lacquer bullets, being made of lacquer coated by glue, are light and readily stick together when falling down the feeding tube 12. Also, several lacquer bullets may clump together at an edge of the feeding opening 11, so that the feeding tube 12 is blocked and firing of lacquer bullets is interrupted, not permitting continuous firing. Then the user has to shake the lacquer bullet gun forcefully to free the lacquer bullets, allowing them to fall down the feeding tube 12 one by one, which is inconvenient for timing of a wargame.

A more advanced storing case and feeding system, as shown in FIG. 4, comprises: a storing case 20, having a curved inner side; a feeding opening 21 at a lowermost location of the storing case 20; a feeding tube 22, continuing from the feeding opening 21; a motor 23 on one side of the feeding tube 22, driving a rotating movement of blades 25; and a battery 24, supplying the motor 23 with power.

When this storing case and feeding system is used, the motor 23 causes the blades 25 to rotate within the storing case 20. By the continuous rotating movement of the blades 25, the lacquer bullets successively fall down the feeding tube 22. However, a regular motor has high power consumption. Once the battery 24 is exhausted, the blades 25 stop rotating, blocking the lacquer bullets, preventing the lacquer bullets from falling down the feeding tube 22. Furthermore, since the blades 25 are placed within the storing case 20, there is no way to accommodate a large number of lacquer bullets therein, otherwise the blades 25 easily block the lacquer bullets, not permitting continuous firing. Then the lacquer bullets have to be stirred manually using a finger to be freed from a blocked state, which is very inconvenient.

SUMMARY OF THE INVENTION

It is the main object of the present invention to provide a lacquer bullet gun feeding system which allows lacquer bullets smoothly to enter a feeding tube.

Another object of the present invention is to provide a lacquer bullet gun feeding system having a storing case with increased capacity where blocked states do not occur.

The present invention can be more fully understood by reference to the following description and accompanying drawings.

DETAILED DESCRIPTION OF THE PREFERRED EMBODIMENT

Figure 1:
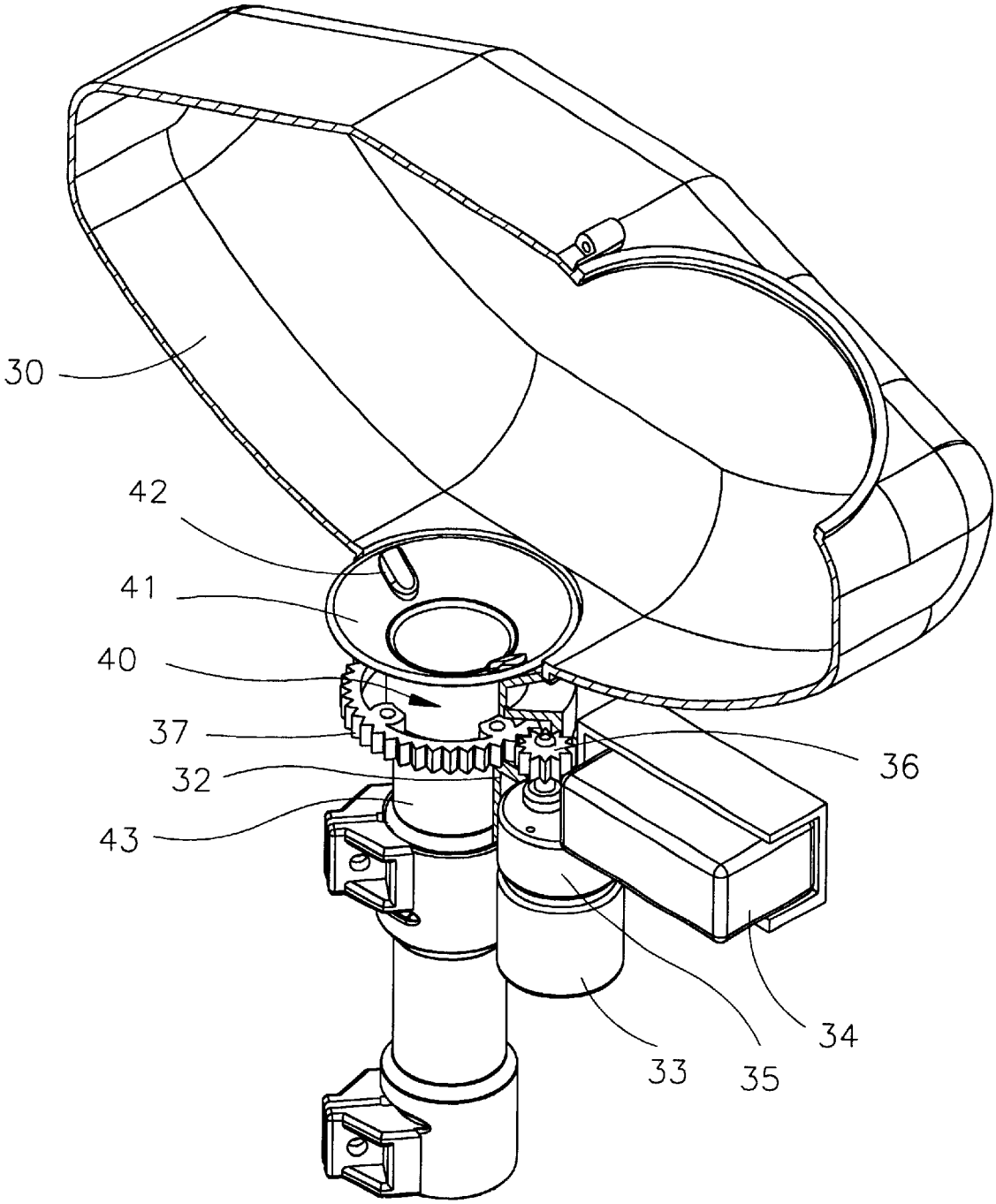
FIG. 1 is a perspective view of the lacquer bullet gun feeding system of the present invention.
Figure 2:
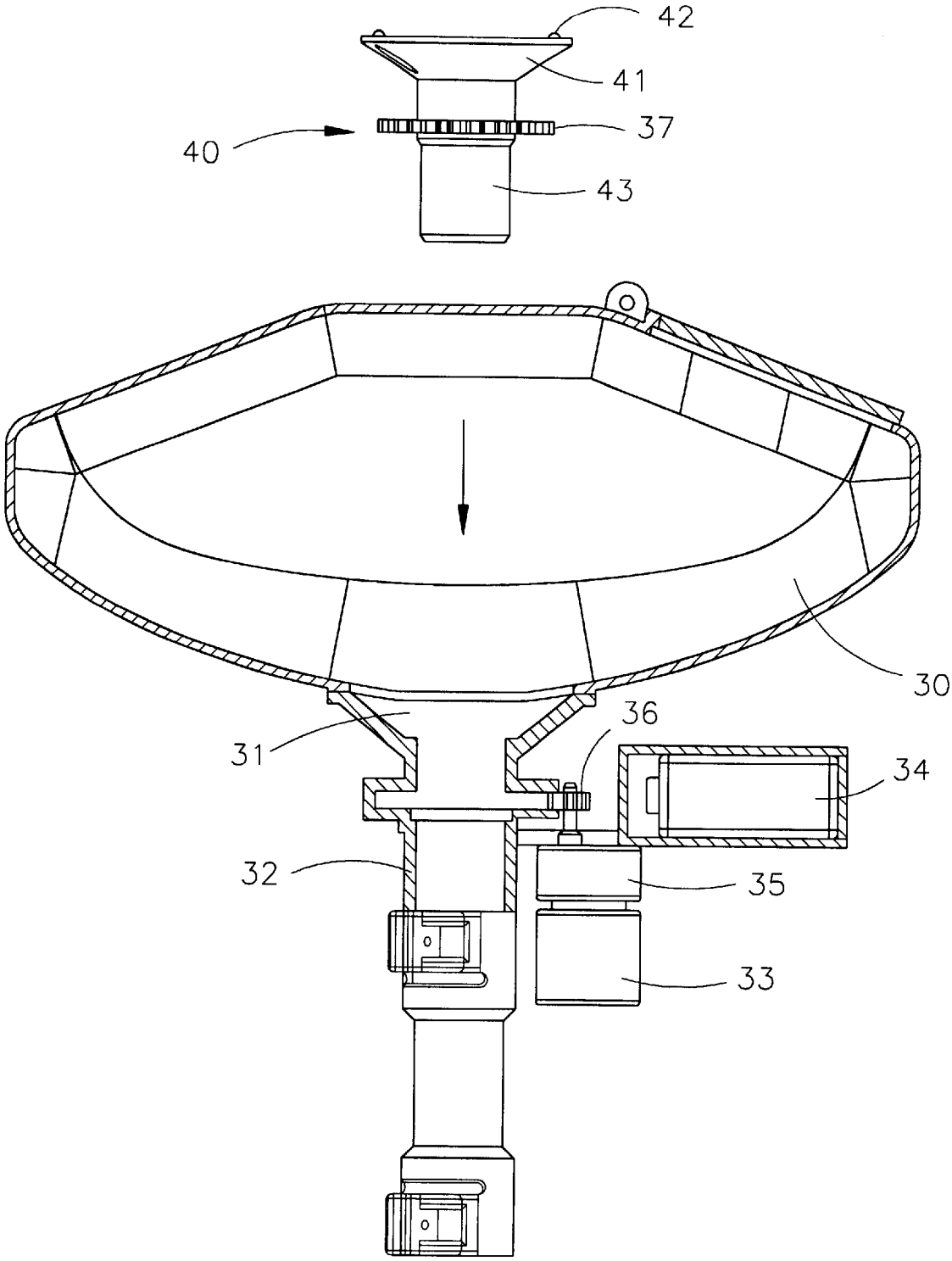
FIG. 2 is a side view of the present invention, with the funnel-shaped turntable extracted.
Figure 3:
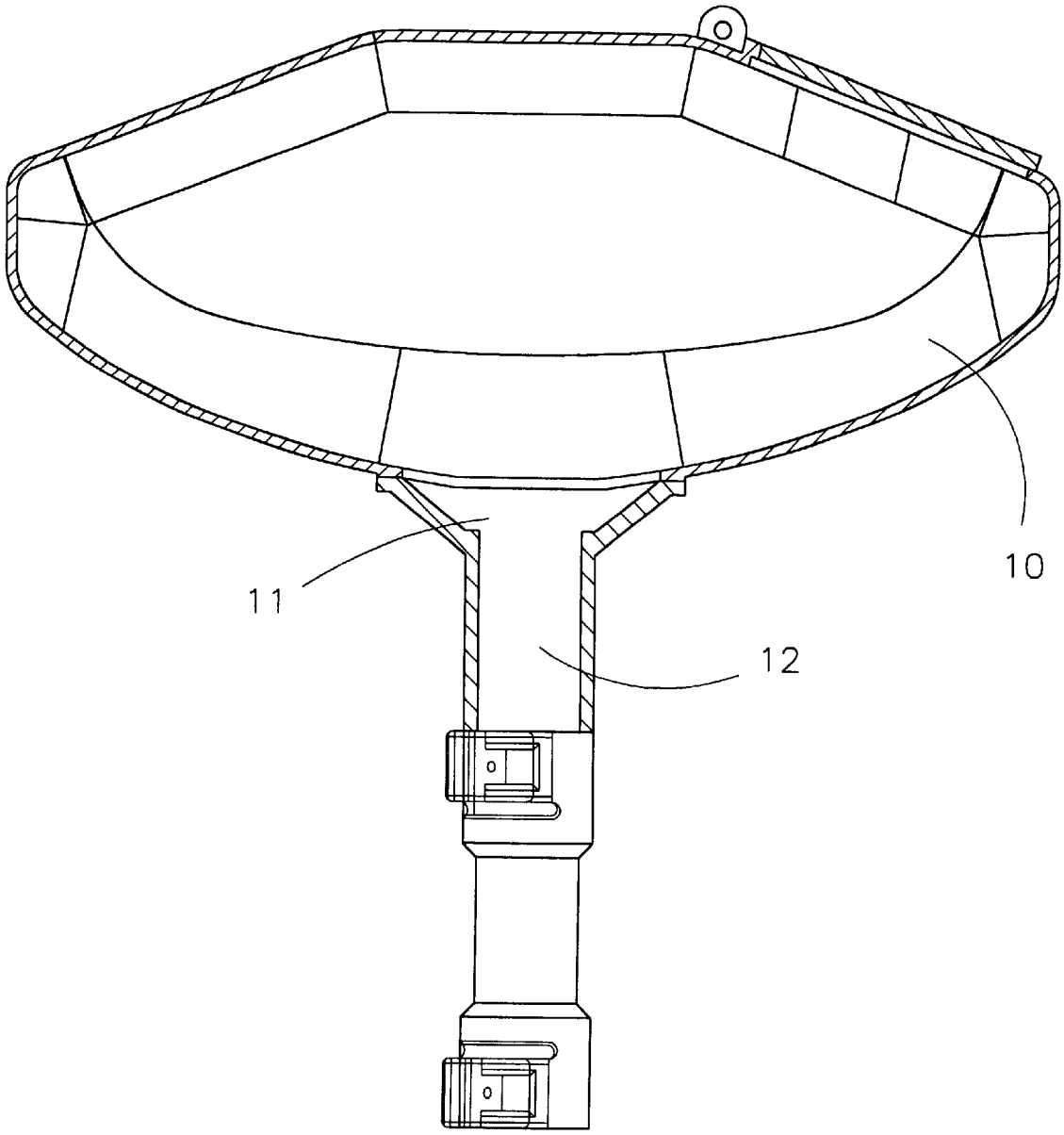
(PRIOR ART) FIG. 3
FIG. 3 (prior art) is a side view of a conventional lacquer bullet gun feeding system.
Figure 4:
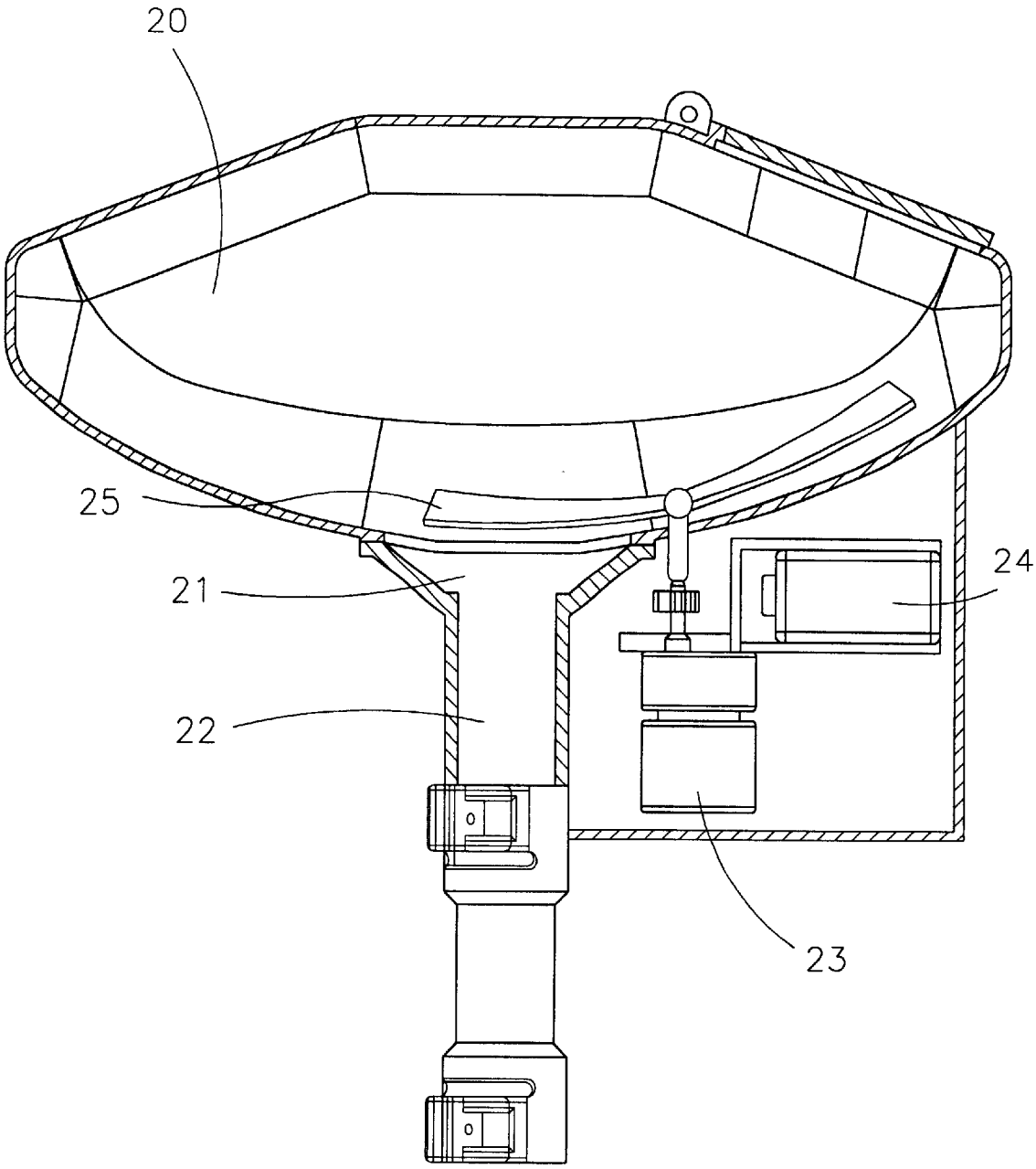
(PRIOR ART) FIG. 4
FIG. 4 (prior art) is a side view of a more advanced conventional lacquer bullet gun feeding system.

As shown in FIGS. 1 and 2, the lacquer bullet gun feeding system of the present invention mainly comprises: a storing case 30, having a curved inner side; a feeding opening 31 at a lowermost location of the storing case 30; a feeding tube 32, continuing from the feeding opening 31; a motor 33, fastened on one side of the feeding tube 33; a battery 34, mounted at one side of the motor 33; and a funnel-shaped turntable 40, placed between the feeding opening 31 and the feeding tube 32.

The battery 34 supplies the motor 33 with power. The motor 33, via speed-reducing gear 35, turns a cog 36. The cog 36 in turn drives a large gear 37, which is mounted on the funnel-shaped turntable 40.

The main characteristic of the present invention is the funnel-shaped turntable 40, having an inclined wall 41, from which at least one projection 42 protrudes upward, and a tube body 43 extending downward from there. The large gear 37 surrounds the tube body 43, being fastened thereon, so that the tube body 43 performs a rotating movement as driven by the cog 36.

Referring to FIG. 2, for using the lacquer bullet gun feeding system of the present invention, the battery 34 is connected to the motor 33 to supply power. Via the gear 35, the cog 36 is turned, driving the large gear 37 which takes along the funnel-shaped turntable 40. During firing of lacquer bullets from the lacquer bullet gun or for inspecting, the funnel-shaped turntable 40 moves continually, with the projections 42 on the inclined wall 41 stirring the lacquer bullets in the storing case 30. Thus the lacquer bullets do not stick together, blocking the feeding opening 31. Being continually stirred, the lacquer bullets orderly and successively fall through the tube body 43 into the feeding tube 32, and no blocking of lacquer bullets occurs. Therefore the storing case 30 of the present invention is able to accommodate a large number of lacquer bullets, and firing of lacquer bullets is smooth and effective.

While the invention has been described with reference to a preferred embodiment thereof, it is to be understood that modifications or variations may be easily made without departing from the spirit of this invention which is defined by the appended claims.

What is claimed is:

1. A lacquer bullet gun feeding system, comprising:

a storing case, having a curved inner side, accommodating lacquer bullets;

a feeding opening at a lowermost location of said storing case, allowing said lacquer bullets to fall through;

a feeding tube, continuing from said feeding opening, guiding said lacquer bullets into a lacquer bullet gun;

a motor, fastened on one side of said feeding tube, driving a cog via speed-changing gear, with said cog in turn driving a large gear;

a battery, supplying said motor with power; and a funnel-shaped turntable, placed on said feeding opening, having an inclined wall with at least one upward projection and a downward extending tube body, surrounded by said large gear which is fixed thereon, so that said funnel-shaped turntable rotates as driven by said cog.

* * * * *